US009318293B2

(12) United States Patent
Magnus et al.

(10) Patent No.: US 9,318,293 B2
(45) Date of Patent: Apr. 19, 2016

(54) ELECTRICAL SWITCHING DEVICE, IN PARTICULAR COMPACT CIRCUIT BREAKER

(71) Applicants: Julia Magnus, Amberg (DE); Timo Malich, Amberg (DE)

(72) Inventors: Julia Magnus, Amberg (DE); Timo Malich, Amberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 250 days.

(21) Appl. No.: 13/671,794

(22) Filed: Nov. 8, 2012

(65) Prior Publication Data

US 2013/0168359 A1 Jul. 4, 2013

(30) Foreign Application Priority Data

Dec. 28, 2011 (DE) ..... 10 2011 090 052

(51) Int. Cl.

| | |
|---|---|
| ***H01H 73/18*** | (2006.01) |
| ***H01H 73/20*** | (2006.01) |
| ***H01H 9/34*** | (2006.01) |
| ***H01H 71/08*** | (2006.01) |

(52) U.S. Cl.

CPC ..... *H01H 73/20* (2013.01); *H01H 9/342* (2013.01); *H01H 71/08* (2013.01); *H01H 73/18* (2013.01)

(58) Field of Classification Search

CPC ..... H01H 9/342; H01H 33/53; H01H 73/18; H01H 73/20; H01H 71/08

USPC ..... 218/155–157, 15, 22, 34, 35

See application file for complete search history.

(56) References Cited

U.S. PATENT DOCUMENTS

| | | | | |
|---|---|---|---|---|
| 3,328,553 | A | 6/1967 | Gryctko | |
| 4,639,564 | A * | 1/1987 | Grunert | H01H 9/342 200/304 |
| 6,198,083 | B1 | 3/2001 | Kramer | |
| 6,281,459 | B1 * | 8/2001 | Munsch et al. | 218/22 |
| 6,624,375 | B2 * | 9/2003 | Leone et al. | 218/155 |
| 6,750,743 | B1 * | 6/2004 | Subramanian et al. | 218/157 |
| 2002/0144978 | A1 | 10/2002 | Leone et al. | |
| 2003/0052091 | A1 | 3/2003 | Hillebrand et al. | |

FOREIGN PATENT DOCUMENTS

| | | |
|---|---|---|
| CN | 2241920 Y | 12/1998 |
| DE | 19860427 A1 | 6/2000 |
| DE | 10131560 C1 | 2/2003 |

OTHER PUBLICATIONS

Chinese Office Action dated Sep. 24, 2015 for corresponding CN Application No. 201210582678.6.

* cited by examiner

*Primary Examiner* — Amy Cohen Johnson
*Assistant Examiner* — Marina Fishman
(74) *Attorney, Agent, or Firm* — Harness, Dickey & Pierce, P.L.C.

(57) ABSTRACT

An electrical switching device is disclosed, including an arc extinguishing apparatus with an extinguishing chamber, a blow-out channel connected to the extinguishing chamber for blowing out plasma and/or gas produced in the extinguishing chamber from the electrical switching device and a terminal apparatus for connecting an electrical conductor to the electrical switching device, the terminal apparatus including a metal part which is electrically conductively connected at a first end to the electrical switching device and which, at its second end, includes a terminal fixing for connecting the electrical conductor, with which the metal part of the terminal apparatus is guidable out of the electrical switching device through the blow-out channel.

17 Claims, 5 Drawing Sheets

ELECTRICAL SWITCHING DEVICE, IN PARTICULAR COMPACT CIRCUIT BREAKER

PRIORITY STATEMENT

The present application hereby claims priority under 35 U.S.C. §119 to German patent application number DE 10 2011 090 052.7 filed Dec. 28, 2011, the entire contents of which are hereby incorporated herein by reference.

FIELD

At least one embodiment of the invention generally relates to an electrical switching device, in particular a compact circuit breaker, comprising an arc extinguishing apparatus having an extinguishing chamber, a blow-out chamber connected to said extinguishing chamber for blowing out plasma and/or gas produced in the extinguishing chamber from the electrical switching device and comprising a terminal apparatus for connecting an electrical conductor to the electrical switching device, wherein the terminal apparatus comprises a metal part, which is electrically conductively connected at a first end to the electrical switching device and which, at its second end, comprises a terminal fixing for connecting an electrical conductor.

BACKGROUND

Electrical switching devices, such as compact circuit breakers, have the task of uncoupling a number of consumers from a power supply network if a specific fault occurs. The classical fault is the occurrence of a short-circuit current and the circuit breakers are conventionally configured to move a switching element in such a short circuit current and thus to decouple the connection between the consumers and the network.

With such electrical switching devices, in the event of a tripping process determined by the short circuit or a manual tripping under load, an arc may occur between two contacts which are separated hereby, and may result in their destruction or in damage to the electrical switching device. To ensure that any arc that occurs can be discharged in a targeted manner, electrical switching devices of this type comprise arch extinguishing apparatuses.

Gases or plasma can develop with the arc within the arc extinguishing apparatus of the electrical switching device, in particular within an extinguishing chamber of the arc extinguishing apparatus, which is/are generated by the high energy density of the arc. This results in a rapid increase in pressure in the housing of the electrical switching device. In order to prevent the pressure increase, the developing gases and/or the developing plasma are blown out of the housing of the electrical switching device. A blow-out channel is provided for this purpose, which is arranged in particular at the end of the arc extinguishing apparatus or at an end of an extinguishing chamber of the arc extinguishing apparatus, which faces away from the contacts of the electrical switching device. The blow-out channel can open out on one side or at the rear side of the electrical switching device.

It is therefore known for instance with electrical switching devices such as compact circuit breakers with double break contacts, that the plasma produced in the event of a short circuit on one side of the electrical switching device is siphoned out below the terminal strips, in other words the terminal on the customer side. The installation space involved in connection technology, in particular the rear connection technology, is herewith restricted and significantly reduced in the event of the connection technology of the blow-out cross-section on the rear side.

With some compact circuit breakers, the problem is solved by them routing the plasma through a contour molded in the housing lower part to the connection technology. The blow-out cross-section of the blow-out channel available is as a result significantly restricted and the remaining installation space is exclusively available for the rear connection technology.

Compact circuit breakers also exist, which guide the rear connection technology rearwards outside of the switch contour, however the installation space of the electrical switching device is significantly enlarged as a result.

SUMMARY

An electrical switching device is disclosed, in particular a circuit breaker, such as a compact circuit breaker, which prevents the preciously cited disadvantages in an electrical switching device of this type. In particular, an electrical switching device, in particular a circuit breaker, such as a compact circuit breaker, is created in at least one embodiment, which, despite the provision of a rear electrical terminal apparatus and a blow-out channel for blowing out gas or plasma from the electrical switching device, is embodied in a compact fashion, and in which a good, in particular symmetrical flow of gas or plasma is ensured through the blow-out channel.

An electrical switching device is disclosed in at least one embodiment, in particular a compact circuit breaker. Further features and details of the invention result from the subclaims, the description and the drawings.

An electrical switching device of at least one embodiment comprises an arc extinguishing apparatus with an extinguishing chamber, a blow-out channel connected to the extinguishing chamber for blowing out plasma and/or gas produced in the extinguishing chamber from the electrical switching device and comprising a terminal apparatus for connecting an electrical conductor to the electrical switching device, wherein the terminal apparatus comprises a metal part, which is electrically conductively connected at a first end to the electrical switching device and which at its second end comprise a terminal fixing for connection of the electrical conductor. In this process, provision is further made in the electrical switching device for the metal part of the terminal apparatus to be guided through the blow-out channel.

BRIEF DESCRIPTION OF THE DRAWINGS

The invention and its developments and its advantages are subsequently explained in more detail with the aid of the drawings, in which.

Elements with the same function and mode of operation are provided with the same reference characters in FIGS. 1 to 10 in each instance.

DETAILED DESCRIPTION OF THE EXAMPLE EMBODIMENTS

Figure 1:
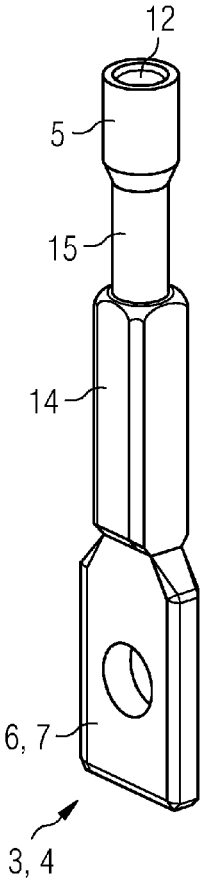
FIG. 1 shows a perspective view of a terminal apparatus of an electrical switching device, which is embodied according to an embodiment of the inventive construction principle.
Figure 2:
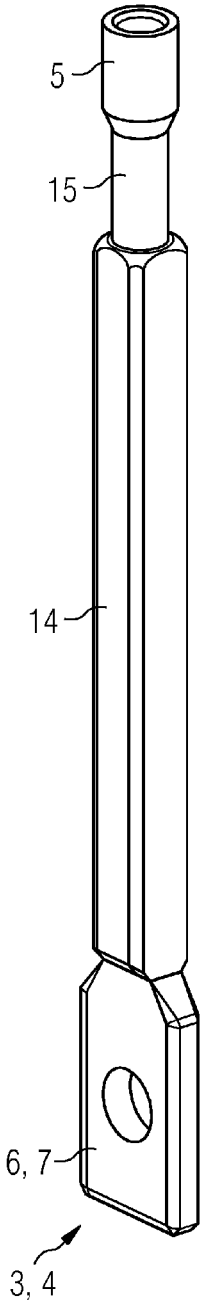
FIG. 2 shows a perspective view of another terminal apparatus of an electrical switching device, which is embodied according to an embodiment of the inventive construction principle.
Figure 3:
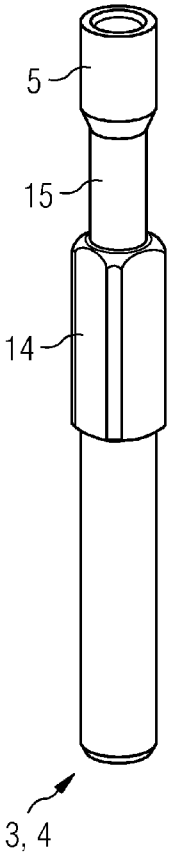
FIG. 3 shows a perspective view of a third terminal apparatus of an electrical switching device, which is embodied according to an embodiment of the inventive construction principle.
Figure 4:
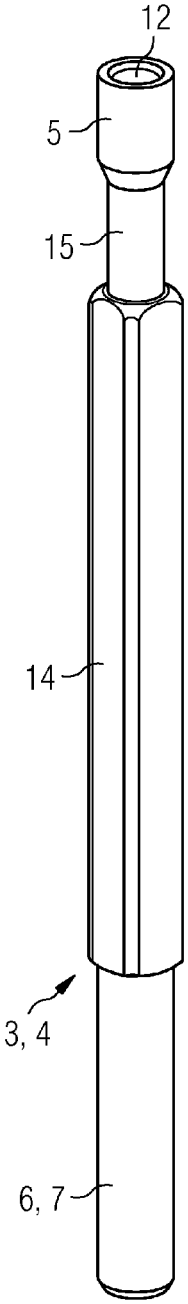
FIG. 4 shows a perspective view of a fourth terminal apparatus of an electrical switching device, which is embodied according to an embodiment of the inventive construction principle.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An electrical switching device of at least one embodiment comprises an arc extinguishing apparatus with an extinguishing chamber, a blow-out channel connected to the extinguishing chamber for blowing out plasma and/or gas produced in the extinguishing chamber from the electrical switching device and comprising a terminal apparatus for connecting an electrical conductor to the electrical switching device, wherein the terminal apparatus comprises a metal part, which is electrically conductively connected at a first end to the electrical switching device and which at its second end comprise a terminal fixing for connection of the electrical conductor. In this process, provision is further made in the electrical switching device for the metal part of the terminal apparatus to be guided through the blow-out channel.

An electrical switching device embodied in this way is embodied in a compact fashion despite the provision of a terminal apparatus and a blow-out channel for blowing out gas and/or plasma from the electrical switching device. Passing the metal part of the terminal apparatus through the blow-out channel does not enlarge the installation space of the electrical switching device and the existing terminal distances of the electrical switching device remain. Passing the metal part through the blow-out channel is also advantageous in that the reduction of the blow-out channel cross-section can be kept to a minimum and a maximum terminal cross-section of the metal part is ensured at the same time. This is possible since no additional double wall thickness is required to delimit the electrical terminal apparatus and the blow-out channel. A good, in particular symmetrical flow of gas and/or plasma through the blow-out channel can also be ensured by passing the metal part through the blow-out channel.

Passing the metal part of the terminal apparatus for an electrical conductor through the channel enables the dimensions of the electrical switching device to be constant, in other words no additional installation space is required for the arrangement of the terminal apparatus and/or the blow-out channel. The blow-out channel is on the one hand connected to the extinguishing chamber of an arch extinguishing apparatus of the electrical switching device. The second end of the blow-out channel advantageously ends in a housing wall of the electrical switching device, so that the gas or plasma flowing through the blow-out channel can be routed out of the electrical switching device. In this process the gases or plasma produced within the extinguishing chamber of the arc extinguishing apparatus, which is/are produced by the high energy density of the arc, are blown out of the housing of the electrical switching device through the blow-out channel, past a part of the metal part.

The part of the metal part of the terminal apparatus which is guided through the blow-out channel can proceed with varying degrees of incline through the blow-out channel. The metal part enters this through the wall of the blow-out channel and can be guided out of the blow-out channel through the opening in the housing of the electrical switching device. It is nevertheless preferred if the metal part enters the blow-out channel through its wall and exits the same through another region of the wall of the blow-out channel.

According to a preferred further development of an embodiment of the invention, provision can be made with one electrical switching device for the metal part to be arranged at right angels or essentially at right angles to the flow direction of the plasma or the gas through the blow-out channel. In other words, the metal part crosses the blow-out channel. In this way the metal part can be guided through the blow-out chamber in such a way that the gases or plasma flow past one side of the metal part. The metal part advantageously passes through the blow-out channel such that the gases or the plasma flow past the metal part on both sides. This ensures that the gases or the plasma, originating from the extinguishing chamber of the electrical switching device, to flow past the metal part symmetrically, so that an undisturbed blow-out of the gas or plasma from the blow-out channel is ensured. In other words, a two-sided flow of the gas or plasma around the metal part ensures a particularly symmetrical flow of plasma or gas and an irrotational flow-out behavior of the plasma or gas from the blow-out channel.

According to a particularly preferred further development of an embodiment of the invention, provision can be made with one electrical switching device for the blow-out channel to end at one side of the electrical switching device and for the metal part of the terminal apparatus to be guided out of the electrical switching device at the rear side of the electrical switching device. This ensures that an electrical connection option is provided on the electrical switching device, which does not interfere with the arrangement of adjacent electrical switching devices and at the same time ensures that the gas or plasma is blown out of the electrical switching device. Bringing the terminal apparatus or the metal part of the terminal apparatus out at the rear of the electrical switching device ensures that the terminal apparatuses on the customer side, in particular terminal strips, are not hindered in any way. In other words, with an arrangement of the blow channel and the terminal apparatus of this type, in other words below the terminal apparatuses on the customer side, in particular terminal strips, it is ensured that the installation space of the electrical switching device is not enlarged. Originally existing terminal spacings of the electrical switching device can remain.

Provision is therefore preferably made in an electrical switching device for the metal part to be arranged below a front terminal facility of the electrical switching device, in particular a front terminal strip of the electrical switching device.

According to a further preferred development of an embodiment of the invention, provision can be made in an electrical switching device for the metal part to be shrouded by an element at least in the region where it passes through the blow-out channel. The metal part is advantageously shrouded to its first end, with which it is electrically conductively connected to the electrical switching device, and its second end, in other words the terminal fixing, by an insulation element. Aside from the safety aspect, this ensures that corrosion of the metal part can be reliably prevented in this region.

Provision can also be made in an electrical switching device for the metal part to be held by a housing element of the electrical switching device, wherein the blow-out channel is guided through the housing element or is formed at least partially by the housing element. This ensures that the metal part is securely held on the electrical switching device. As a result of the blow-out channel being guided through the housing element, this is also securely held on the electrical switching device. The blow-out channel is preferably at least partly formed by the housing element. This enables costs to be saved when manufacturing the electrical switching device, since no additional blow-out channel has to be produced. In particular, the blow-out channel can be embodied in one piece with the housing element of the electrical switching device.

Alternatively to the electrical switching device described in the previous paragraph, provision can be made in accordance with one particularly preferred further development of an embodiment of the invention in an electrical switching device for the metal part to be held by an insulation facility fastened detachably to the electrical switching device, which surrounds at least regions of the metal part. The metal part forms, together with the insulation facility, a unit, which can be fastened to the electrical switching device. In this way the unit, including a metal part and insulation facility, can be arranged on the electrical switching device, in particular in a cut-out of the electrical switching device provided accordingly thereon. An electrical switching device is particularly preferred in which the unit, including a metal part and insulation facility, is arranged below a front terminal facility, in particular below terminal strips on the front side, in particular below a terminal strip on the front side, of the electrical switching device. An embodiment of an electrical switching device of this type enables the unit to be easily and rapidly fastened to an electrical switching device, or released herefrom. Similarly, it is ensured that the metal part can be easily and securely electrically connected to the electrical switching device by fastening the insulation facility to the electrical switching device.

An electrical switching device, in which the insulation facility forms the outlet channel totally or at least partly, is preferred in an embodiment. The insulation facility can be embodied such that it can be connected directly to the extinguishing chamber of the arc extinguishing apparatus of the electrical switching device. In this case, the blow-out channel is completely formed by the insulation facility. Alternatively, provision can be made for this purpose for the replaceable insulation facility to only form part of the blow-out channel of the electrical switching device. The other part of the blow-out channel can either be formed by regions of the housing of the electrical switching device and/or by regions of the extinguishing chamber of the arc extinguishing apparatus.

The first end of the metal part is electrically conductively connected to the electrical switching device. An electrical switching device, in which the first end of the metal part comprises a flat terminal, in particular a flat terminal with multiple bends, or a screw terminal provided with a thread, is preferred. This herewith ensures that the first end of the metal part of the terminal apparatus can be easily connected to corresponding terminals of the electrical switching device.

According to a further preferred development of an embodiment of the invention, provision can be made in an electrical switching device for at least one flow line-shaped body to be arranged in the region of the metal part, which is guided through the blow-out channel. This means that at least one flow line-shaped body preferably surrounds the metal part in the region passing through the blow-out channel. This herewith ensures that the gases flowing along the metal part and/or the plasma flowing along the metal part are routed irrotationally along the metal part in order thus to ensure a rapid and simple blowing out of the gases and/or the plasma. Two or more flow line-shaped bodies can also be provided around the metal part in the region passing through the blow-out channel. The at least one flow line-shaped body can be arranged directly on the metal part. An electrical switching device, in which the at least one flow line-shaped body is part of the insulation facility, is preferred. In this process, the at least one flow line-shaped body can be arranged on the insulation facility such that it does not cause any rotation of the gas or plasma flowing along the metal part or around the metal part. The at least one flow line-shaped body has the functionality of an accessory element.

The electrical switching device may be a circuit breaker, in particular a compact circuit breaker. The electrical switching device is particularly preferably a compact circuit breaker with double break contacts. The double break contacts of the compact circuit breaker are preferably embodied as a rotational double contact. With a compact circuit breaker of this type, two arc extinguishing apparatuses are preferably provided with an extinguishing chamber in each instance. A compact circuit breaker of this type further comprises a blow-out channel preferably for each arc extinguishing apparatus for the corresponding extinguishing chamber of the arc extinguishing apparatus. Furthermore, a compact circuit breaker of this type comprises a corresponding terminal apparatus for each blow-out channel, as is described previously.

FIGS. 1-4 each show a schematic perspective view of various terminal apparatuses 3 for an electrical switching device 1, which is embodied according to the inventive construction principle. All four terminal apparatuses comprise a metal part 4, which has a first end 5 for connection to the electrical switching device 1 and a second end 6 with a terminal fixing 7 for connecting an external electrical conductor. The metal parts 4 of the terminal apparatuses 3 according to FIG. 1-4 are embodied such that they can be passed through a blow-out channel of the electrical switching device 1. In particular, the terminal apparatuses 3 comprise a region 15, which can be guided through a blow-out channel 2 of an electrical switching device 1. A central region of the metal part 4 is identified with reference character 14, which has an angular, in particular a rectangular cross-section, which is used as an anti-twist device of the terminal apparatus 3 relative to the electrical switching device 1, in particular relative to a housing element of the electrical switching device 1, or relative to an insulation facility 11.

Figure 5:
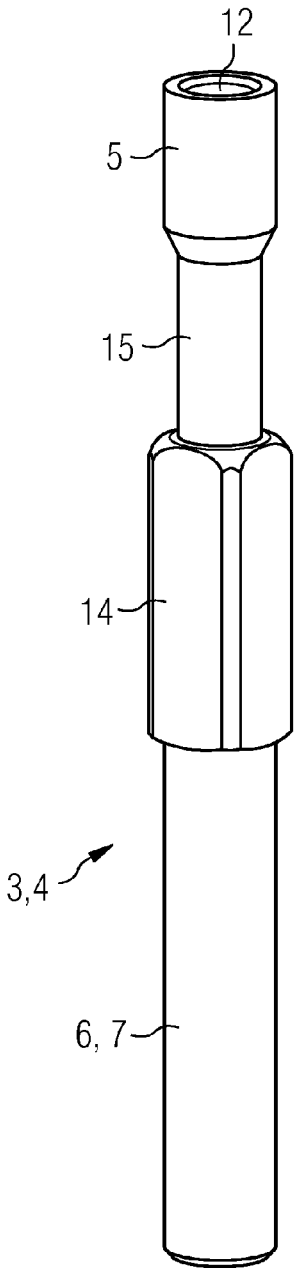
FIG. 5 shows a perspective view of the terminal apparatus according to FIG. 3.

FIG. 5 shows a perspective view of the terminal apparatus 3 according to FIG. 1. The first end 5 of the metal part 4 of the terminal apparatus 3 is embodied as a screw terminal 12 with an inner thread. This screw terminal 12 is used for easy fastening of the metal part 4 to a corresponding conducting part, in particular to a screw, of the electrical switching device 1.

Figure 6:
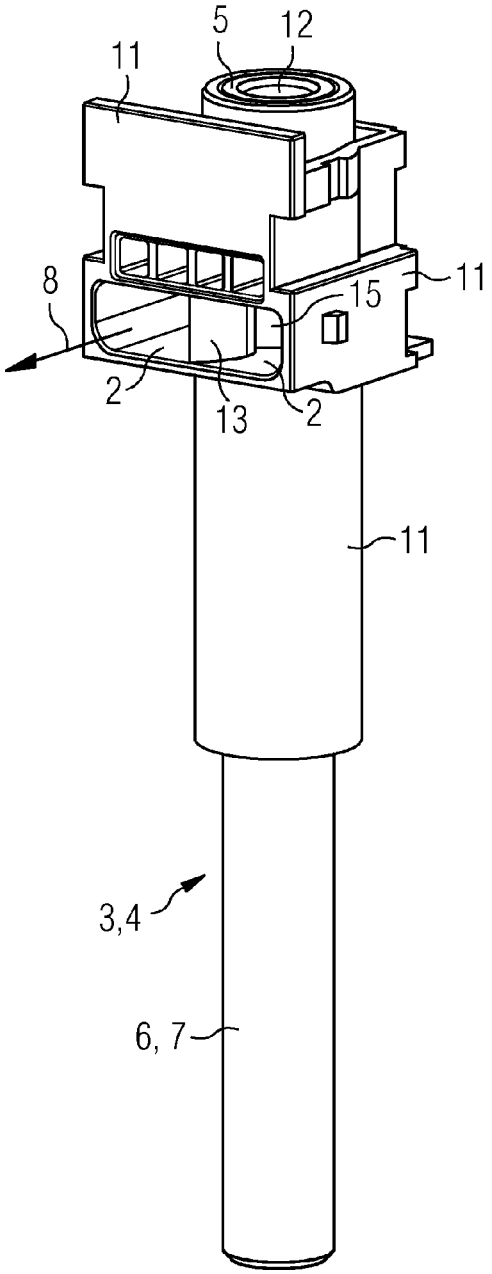
FIG. 6 shows a perspective view of a unit, consisting of a terminal apparatus according to FIG. 5 and an insulation facility, of an electrical switching device, which is embodied according to an embodiment of the inventive construction principle.

FIG. 6 shows a perspective view of the terminal apparatus according to FIG. 5, which is arranged on an insulation facility 11. The insulation facility 11 surrounds the first end 5, the central region 14 and the region of the metal part 4, which is formed by the blow-out channel 2 of the insulation facility 11. This means that the metal part 4 is held by the insulation facility 11. The insulation facility 11 is preferably embodied as a plastic part. The insulation facility 11 forms the blow-out channel 2.

The terminal apparatus 3 is arranged here on the insulation facility 11 such that the metal part 4 of the terminal apparatus 3 is guided through the blow-out channel 2. In particular, the metal part 4 is arranged at right angles to the flow direction 8 of the plasma or the gas through the blow-out channel 2.

The insulation facility 11 also comprises at least flow line-shaped body 13, which is arranged in the flow direction 8 on the region of the metal part 4, which is guided through the blow-out channel 2. The at least one flow line-shaped body 13 ensures its symmetrical flow of gas or plasma about the metal part 4 in the region of the blow-out channel 2. In particular, the flow line-shaped body 13 ensures an irrotational flow-out behavior of the gas or plasma, without reducing the blow-out cross-section of the blow-out channel 2.

An arrangement of the metal part 4 of the terminal apparatus 3 of this type through the blow-out channel 2 of the insulation facility 11 ensures that after connecting the unit, consisting of insulation facility 11 and terminal apparatus 3, the installation space of the electrical switching device 1 is not enlarged. Passing the metal part 4 of the terminal apparatus 3 through the blow-out channel 2 of the insulation facility 11 can reduce the blow-out cross-section of the blow-channel 2 to a minimum and at the same time reach the maximum terminal cross-section of the metal part 4. This is in particular ensured such that no additional, double wall thickness is required to delimit the terminal apparatus 3 and the blow-out channel 2.

Figure 7:
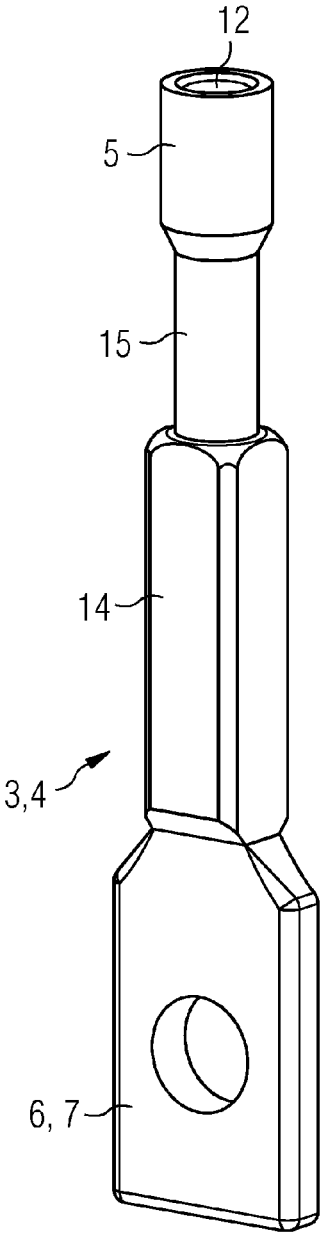
FIG. 7 shows a further representation of the terminal apparatus according to FIG. 1.
Figure 8:
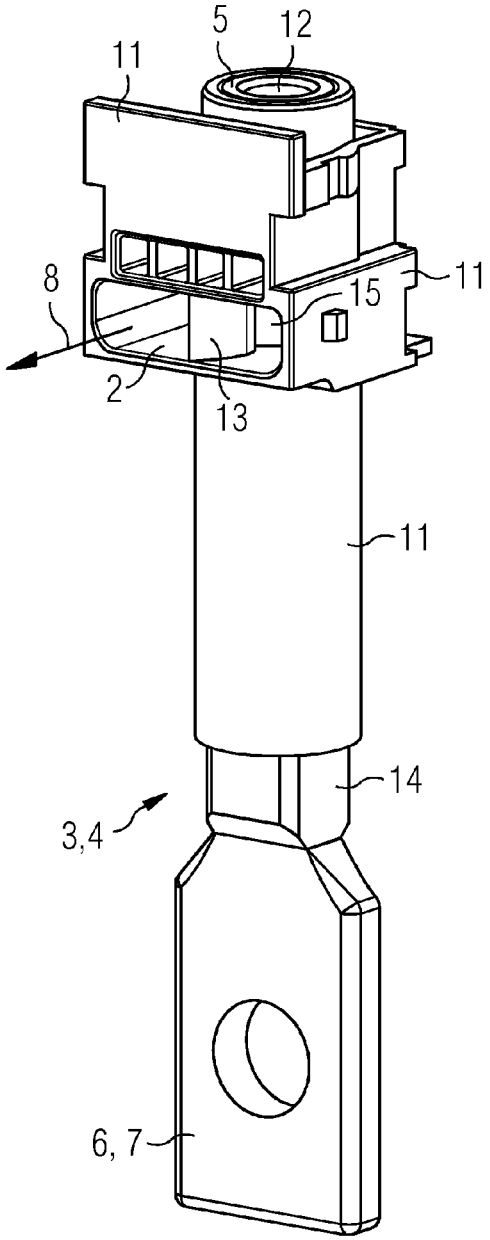
FIG. 8 shows a perspective view a unit, including a terminal apparatus according to FIG. 7 and an insulation facility, of an electrical switching device, which is embodied according to an embodiment of the inventive construction principle.

FIGS. 7 and 8 correspond to FIGS. 5 and 6, wherein the terminal apparatus 3, in comparison with the terminal apparatus 3 according to FIGS. 5 and 6, comprises a different terminal fixing 7 at the second end 6 of the metal part 4.

Figure 9:
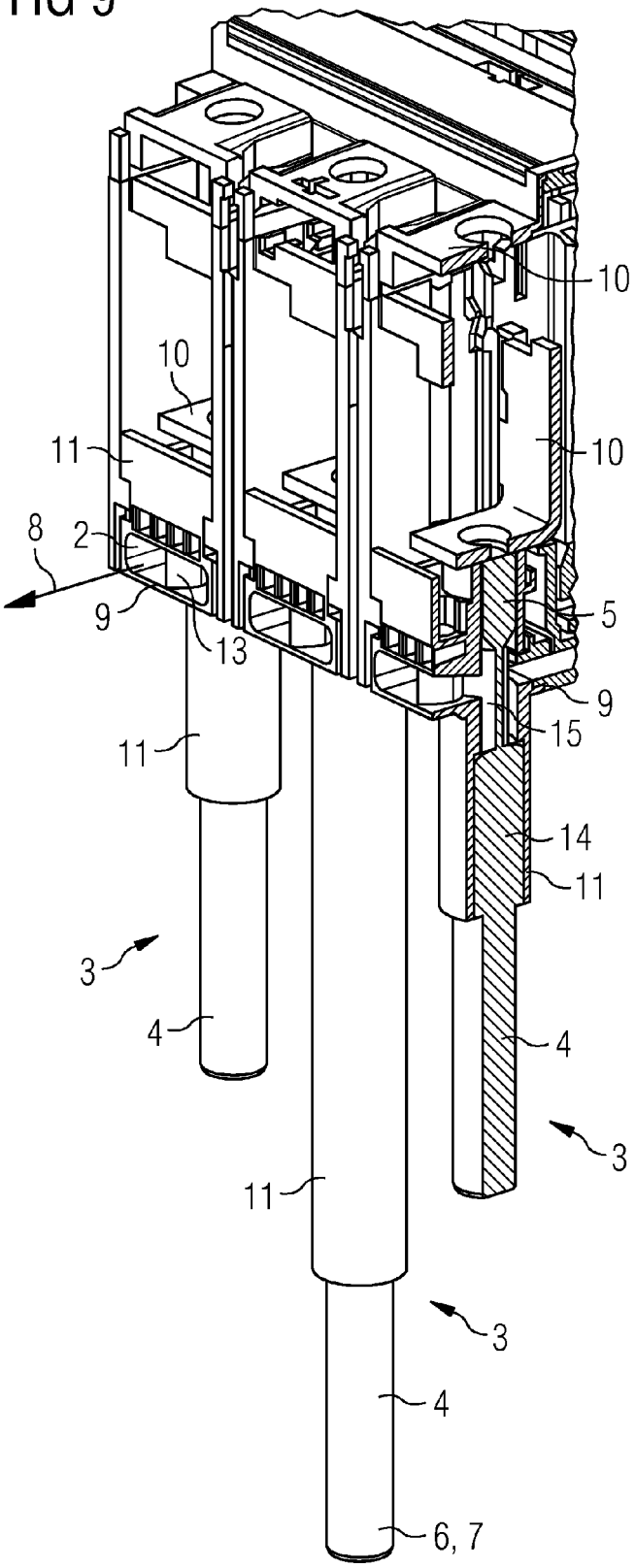
FIG. 9 shows a perspective view of the region of an electrical switching device, which is embodied according to an embodiment of the inventive construction principle, to which three different terminal apparatuses are connected.
Figure 10:
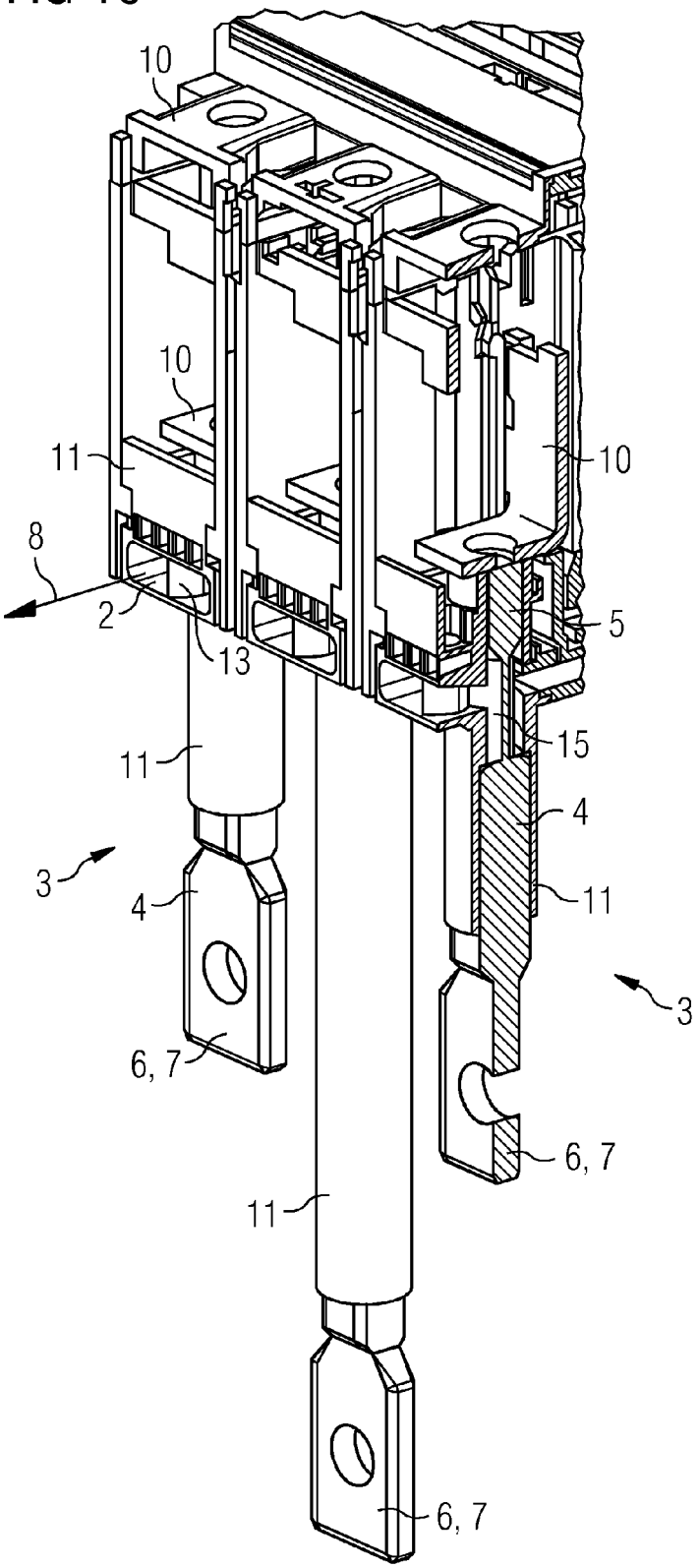
FIG. 10 shows a perspective view of the region of an electrical switching device, which is embodied according to an embodiment of the inventive construction principle, on which three different terminal apparatuses, compared with FIG. 9, are arranged.

FIGS. 9 and 10 each show in a schematic representation a perspective view of the region of an electrical switching device 1, on which the terminal apparatus 3 and the blow-out channel 2 of the electrical switching device 1 are provided. The electrical switching device 1 comprises three front terminal facilities 10, and these are used to connect an electrical conductor by a user of the electrical switching device 1. In addition to the front terminal facilities 10, three terminal apparatuses 3 are arranged, which are used to connect additional electrical conductors to the electrical switching device 1. The terminal apparatuses 3 are held by insulation facilities 11 in each instance, which are arranged below the front terminal facilities 10 within the contour of the electrical switching device 1.

The metal pieces 4 of the terminal apparatuses 3 are guided to the rear here through the blow-out channels 2 out of the electrical switching device 1 and as a result form the rear electrical connection to the electrical switching device 1. Each metal part 4 is held by an insulation facility 11 fastened visibly to the electrical switching device 1. Each insulation facility 11 forms at least one part of the blow-out channel 2 and comprises at least one flow line-shaped body 13, which is arranged adjacent to the region 15 of the metal part 14, which proceeds through the blow-out channel 2. The metal part 4 of the terminal apparatuses 3 comprises a central region 14, which has a non round cross-section, in particular a rectangular cross-section, as a result of which the metal part 4 is positioned in the respective insulation facilities 11 in an anti-twist manner.

The first ends 5 of the metal parts 4 are arranged on the electrical switching device 1 such that these can be easily electrically conductively connected to the respective front terminal facilities 10. The first ends 5 of the metal parts 4 of the terminal apparatuses 3 preferably comprise a flat terminal with multiple bends, in particular a flat terminal angled in 45° steps, which can be latched onto a corresponding electrical conductor of the electrical switching device 1. The first end 5 of the metal part 4 is embodied in FIGS. 9 and 10 as a screw terminal 12 provided with a thread. The second ends 6 of the metal parts 4 can either also be embodied as flat terminal, in particular as a flat terminal with multiple bends, or as a screw terminal 12 provided with a thread.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 electrical switching device
2 blow-out channel
3 terminal apparatus
4 metal part
5 first end of the metal part
6 second end of the metal part
7 terminal fixing
8 flow direction
9 rear side of the electrical switching device
10 front-side terminal facility of the electrical switching device
11 insulation facility
12 screw terminal
13 flow line-shaped body
14 central region of the metal part
15 region of the metal part in the blow-out channel

What is claimed is:

1. An electrical switching device, comprising:

an arc extinguishing apparatus including an extinguishing chamber;

a blow-out channel connected to the extinguishing chamber, configured to blow out, through an opening of the blow-out channel, at least one of plasma and gas produced in the extinguishing chamber from the electrical switching device; and a terminal apparatus, configured to connect an electrical conductor to the electrical switching device, including a metal part electrically conductively connected at a first end to the electrical switching device and, at a second end, a terminal fixing configured to connect the electrical conductor, the metal part being guidable through the blow-out channel so that a portion of the metal part including the second end protrudes beyond a rear side of the electrical switching device to expose the portion to external surroundings of the electrical switching device, wherein, the metal part is shrouded at least in the region passing through the blow-out channel by an insulation element such that the insulation element surrounds an entire portion of the metal part that is arranged in the blow-out channel, and the insulation element surrounds a part of the portion of the metal part protruding beyond the rear side of the electrical switching device.

2. The electrical switching device of claim 1, wherein the metal part is arranged substantially at right angles to a flow direction of the plasma or the gas through the blow-out channel.

3. The electrical switching device of claim 1, wherein the blow-out channel ends on one side of the electrical switching device.

4. The electrical switching device of claim 1, wherein the metal part is arranged below a front terminal facility of the electrical switching device.

5. The electrical switching device of claim 1, wherein the metal part is held by a housing element of the electrical switching device, and wherein the blow-out channel is guided through the housing element or is formed at least partially by the housing element.

6. The electrical switching device of claim 1, wherein the metal part is held by the insulation element, and the insulation element is fastened detachably to the electrical switching device.

7. The electrical switching device of claim 6, wherein the insulation element forms the blow-out channel at least partly.

8. The electrical switching device of claim 1, wherein the first end of the metal part comprises a flat terminal or a screw terminal provided with a thread.

9. The electrical switching device of claim 7, wherein at least one flow line-shaped body is arranged around the region of the metal part, which is guided through the blow-out channel.

10. The electrical switching device of claim 9, wherein the at least one flow line-shaped body is part of the insulation element.

11. The electrical switching device of claim 1, wherein the electrical switching device is a circuit breaker.

12. The electrical switching device of claim 2, wherein the blow-out channel ends on one side of the electrical switching device.

13. The electrical switching device of claim 4, wherein the metal part is arranged below a front terminal strip of the electrical switching device.

14. The electrical switching device of claim 1, wherein the first end of the metal part comprises a flat terminal with multiple bends, or a screw terminal provided with a thread.

15. The electrical switching device of claim 1, wherein at least one flow line-shaped body is arranged around the region of the metal part, which is guided through the blow-out channel.

16. The electrical switching device of claim 11, wherein the electrical switching device is a compact circuit breaker.

17. The electrical switching device of claim 1, wherein the metal part has a rectangular cross-section that engages with the insulation element in an anti-twist manner.

* * * * *